US006076378A

United States Patent [19]

Shin

[11] Patent Number: 6,076,378

[45] **Date of Patent: *Jun. 20, 2000**

[54] FILTER FOR A WASHING MACHINE

[75] Inventor: Jung-soo Shin, Suwon, Rep. of Korea

[73] Assignee: Samsung Electronics Co., Ltd., Suwon, Rep. of Korea

[ * ] Notice: This patent is subject to a terminal disclaimer.

[21] Appl. No.: 09/028,526

[22] Filed: Feb. 24, 1998

[30] Foreign Application Priority Data

Aug. 16, 1997 [KR] Rep. of Korea ..... 97-39040

[51] Int. Cl.[7] ..... D06F 29/00

[52] U.S. Cl. ..... 68/18 F; 210/346

[58] Field of Search ..... 68/18 F; 210/167, 210/196, 238, 346

[56] References Cited

U.S. PATENT DOCUMENTS

| | | |
|---|---|---|
| 2,939,305 | 6/1960 | Snyder et al. . |
| 4,566,970 | 1/1986 | Piai et al. . |
| 5,509,283 | 4/1996 | Lee et al. . |
| 5,645,721 | 7/1997 | Carroll, Jr. . |
| 5,661,989 | 9/1997 | Jeon et al. . |
| 5,863,423 | 1/1999 | Shin et al. . |

FOREIGN PATENT DOCUMENTS

| | | |
|---|---|---|
| 56-78780 | 11/1954 | Japan . |
| 57-38690 | 8/1955 | Japan . |
| 4-125891 | 11/1992 | Japan . |
| 4-130785 | 11/1992 | Japan . |
| 288 469 | 10/1996 | Taiwan . |

*Primary Examiner*—Frankie L. Stinson
*Attorney, Agent, or Firm*—Burns, Doane, Swecker & Mathis, L.L.P.

[57] ABSTRACT

A filter for a washing machine is disclosed. The filter includes a check valve fixed to the lower side of a rear panel of a pocket type filter for confining the flow of the washing water introduced into the pocket type filter. The check valve has a fixing portion which is fixed to the lower side of the rear panel by being inserted into a fixing recess formed at the lower side of the rear panel, a moving plate which is extended from the fixing portion to be inclined toward the front panel and opens/closes the space between the front panel and the rear panel, and a connecting portion for connecting the fixing portion to the moving plate and having a thickness thinner than the moving plate in order to reliably move the moving plate. Since the moving plate is upwardly inclined toward the inner side of the front panel, the check valve is capable of supporting the weight of the fluff by which the upper portion of the moving plate contacts and frictionizes the inner side of the front panel even if a lot of fluff is accumulated in the pocket type filter. Therefore, the leakage of the fluff accumulated in the pocket type filter due to its weight can be prevented.

3 Claims, 6 Drawing Sheets

FILTER FOR A WASHING MACHINE

BACKGROUND OF THE INVENTION

1. Field of the Invention

The present invention relates to a washing machine, and more particularly to a filter for a washing machine for filtering foreign matters such as fluff from washing water.

2. Description of the Prior Art

FIG. 1 illustrates a conventional washing machine. Referring to FIG. 1, in the conventional washing machine, a washing tub 120 is suspended by a suspension 130 into inside of a case 110.

A dehydrating tub 170 and a pulsator (or an agitator; hereinafter refer to "a pulsator") 180 selectively driven by a clutch assembly 160 which is connected to a motor 150 by means of a belt 140, are disposed in the inner side of washing tub 120.

An impeller 182 as a pump is integrally formed to the lower side of pulsator 180, and a filter 190 is provided around the upper end of dehydrating tub 170. A guide portion 172 for guiding the washing water pumped by impeller 182 toward filter 190 is formed between impeller 182 and filter 190.

In the washing machine constructed as above, once pulsator 180 is rotated by motor 150 and clutch assembly 160 during a washing or rinsing cycle, the washing water pumped by impeller 182 at the lower portion of pulsator 180 is guided to filter 190 along guide portion 172 to be dropped into the interior of dehydrating tub 170 via filter 190. During this process, foreign matters intermingled in the washing water are filtered by filter 190.

However, according to the conventional washing machine constructed as above, filter 190 is arranged around the upper end of dehydrating tub 170. For this reason, when a small amount of articles is washed in a small quantity of cleaning water, the washing water cannot reach filter 190. That is, the foreign matters intermingled in the washing water cannot be sufficiently filtered by filter 190 to lower washing efficiency.

FIGS. 2 to 4 show another example of a filter for a washing machine proposed to overcome the above described problems as a example.

As illustrated, the filter for a washing machine is attached to the inner lower portion of dehydrating tub 170, which includes a filter case 300 and a pocket type filter 200 for filtering fluff by being inserted into filter case 300.

Filter case 300 is attached to the inner lower portion of dehydrating tub 170 to form a predetermined space with dehydrating tub 170, which includes an attachment portion 310 for attaching itself onto dehydrating tub 170, a front plane portion 320 formed with a plurality of discharging holes 322 and inserting guide portions 330 formed to both rear sides of front plane portion 320 while having the upper portion opened.

Pocket type filter 200 includes a front panel 210, a rear panel 230 and a check valve 250. Front panel 210 and rear panel 230 are coupled to be opened/closed by a hinge shaft 232 formed to rear panel 230, and attached with mesh nets 220 and 240 for filtering the fluff. Check valve 250 for opening/closing the space between front panel 210 and rear panel 230, is fixed to the lower side of rear panel 230 and made of a material such as a rubber.

Pocket type filter 200 as described above is inserted into the interior of the space between filter case 300 and dehydrating tub 170 by being slidably moved along inserting guide portions 330 from the upper portion of inserting guide portions 330 of filter case 300.

According to the filter as described above, the washing water pumped by impeller 182 flows into pocket type filter 200 via the space between dehydrating tub 170 and filter case 300 during the washing or rinsing cycle. Check valve 250 is upwardly pushed away by means of the washing water thereby the washing water is introduced into the interior of pocket type filter 200.

The washing water introduced into inside of pocket type filter 200 is discharged into dehydrating tub 170 via mesh nets 220 and 240 of front panel 210 and rear panel 230. At this time, the fluff within the washing water is filtered by mesh nets 220 and 240 attached to the front panel 210 and rear panel 230. Also, the washing water exhausted out of pocket type filter 200 is discharged into the interior of dehydrating tub 170 via discharging holes 322 formed in front plane portion 320 of filter case 300.

Under the state that the rotation of a pulsator is stopped after completing the washing or rinsing cycle, check valve 250 returns to its original position by means of gravity. Consequently, the filtered fluff is accumulated into the interior of pocket type filter 200 without getting away from pocket type filter 200.

The fluff accumulated on the interior of pocket type filter 200 is closely attached toward rear panel 230 due to a centrifugal force exerting upon the fluff by dehydrating tub 170 which is rotated at high speed during a dehydrating cycle. By doing so, the washing water pumped by impeller 182 can be easily introduced into pocket type filter 200 during the initial period of the next washing or rinsing cycle.

Meanwhile, as the amount of the fluff accumulated within pocket type filter 200 is increased, user grasps the upper portion of the pocket type filter and moved pocket type filter 200 in upper direction along inserting guide 230 of the filter case so as to separating pocket type filter 200 from the space between filter case 300 and dehydrating tub 170, then opens pocket type filter 200 and removes the fluff.

According to the another example of the filter of the prior art, check valve 250 seals the space between front panel 210 and rear panel 230 by means of its edge parallel contacting the inner side of front panel 210. If a lot of the fluff is accumulated in pocket type filter 200, the fluff accumulated in pocket type filter 200 is usually leaked down between check valve 250 and front panel 210 by reason that check valve 250 does not support the weight of the fluff containing moisture and is sunk down.

To overcome the above-describe drawback, if check valve 250 is set to thick to be able to support the weight of the fluff accumulated in pocket type filter 200, it is difficult for check valve to be pushed up by the washing water so that the efficiency of the washing water introduced into pocket type filter 200 is not enough. Therefore, the capacity of pocket type filter is lowered and the washing effect of a washing machine is deteriorated.

SUMMARY OF THE INVENTION

Therefore, it is an object of the present invention to provide a filter for a washing machine capable of preventing leakage of fluff due to the weight of the fluff accumulated therein.

To achieve the object, the present invention provides a filter for a washing machine comprising a filter case attached to an inner lower portion of a dehydrating tub of the washing machine for forming a predetermined space with the dehydrating tub, including an attachment portion for being attached to the dehydrating tub and a filter receiving portion formed with an opening portion, and a pocket type filter including a front panel attached with a mesh net to one side thereof and formed with a penetrating hole at upper portion thereof for filtering fluff intermingled in washing water, a rear panel for forming a predetermined space with the front panel by being coupled to the front panel by hinge shafts to be opened/closed while being attached with a mesh net for filtering the fluff intermingled in the washing water to one side thereof, and a check valve fixed to be upwardly inclined toward the front panel to a lower side of the rear panel for confining the flow of the washing water introduced into the space between the front panel and the rear panel, the pocket type filter being inserted into the filter receiving portion.

According to the present invention, the check valve includes a fixing portion which is fixed to the lower side of the rear panel by being inserted into a fixing recess formed at the lower side of the rear panel, and a moving plate which is extended from the fixing portion to be inclined toward the front panel and opens/closes the space between the front panel and the rear panel. More preferably, the check valve includes also a connecting portion for connecting the fixing portion to the moving plate and having a thickness thinner than the moving plate.

According to a feature of the present invention, since the moving plate is upwardly inclined toward the inner side of the front panel, the check valve is capable of supporting the weight of the fluff by which the upper portion of the moving plate contacts and frictionizes the inner side of the front panel even if a lot of fluff is accumulated in the pocket type filter 400. Therefore, it is prevented from separating of the moving plate from the front panel occurred by which the moving plate is sunk down, so that the fluff accumulated in the pocket type filter does not leak out.

In addition, since the connecting portion disposed between the moving plate and the fixing portion of check valve has a thinner thickness less than the thickness of the moving plate, so that the moving plate 454 may easily move regardless of being a little thicker.

BRIEF DESCRIPTION OF THE DRAWINGS

The above objects and other advantages of the present invention will become more apparent by describing in detail preferred embodiments thereof with reference to the attached drawings in which.

DETAILED DESCRIPTION OF THE PREFERRED EMBODIMENTS

Figure 1:
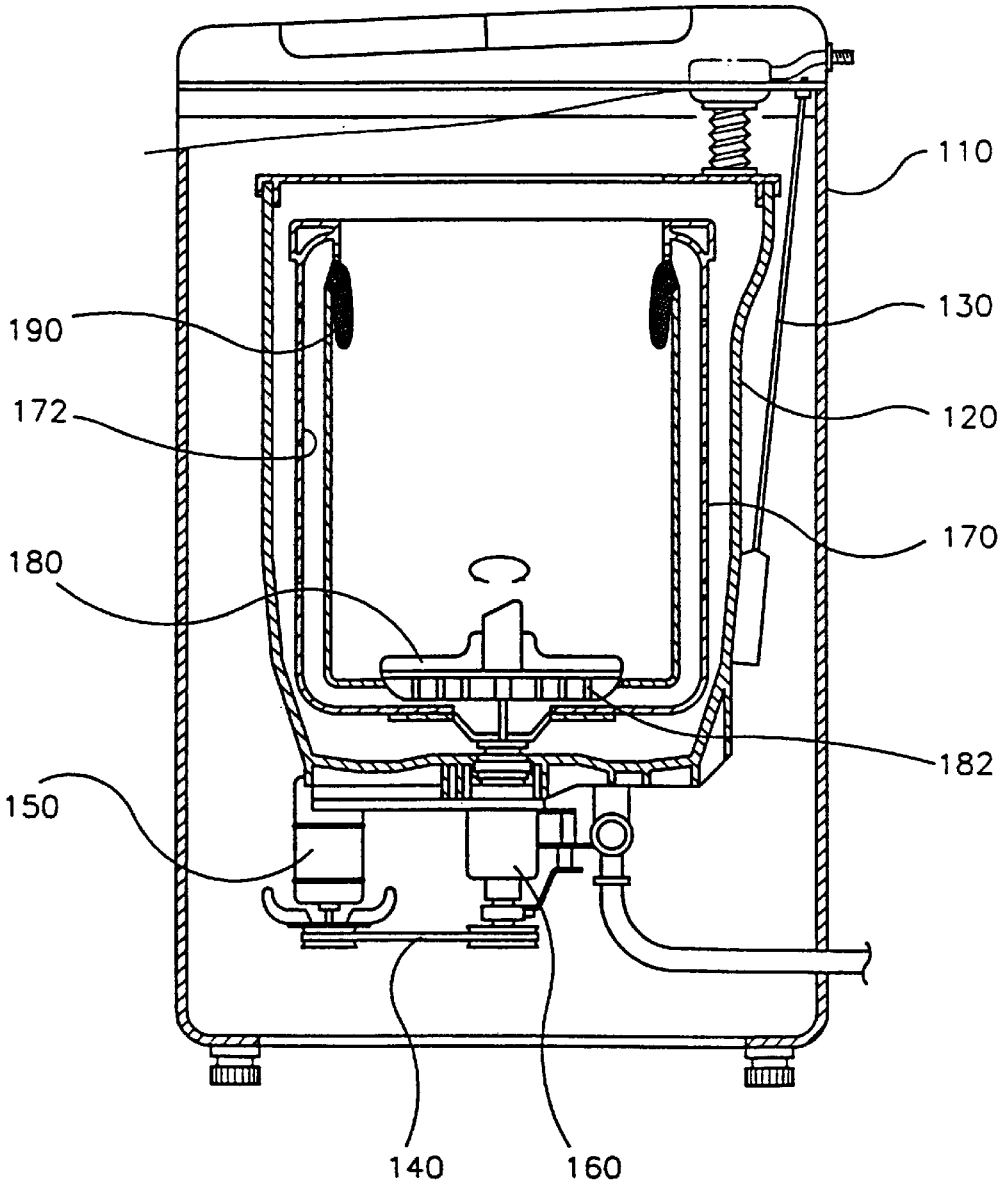
FIG. 1 PRIOR ART
FIG. 1 is a sectional view showing a general full automatic washing machine having a filter.
Figure 2:
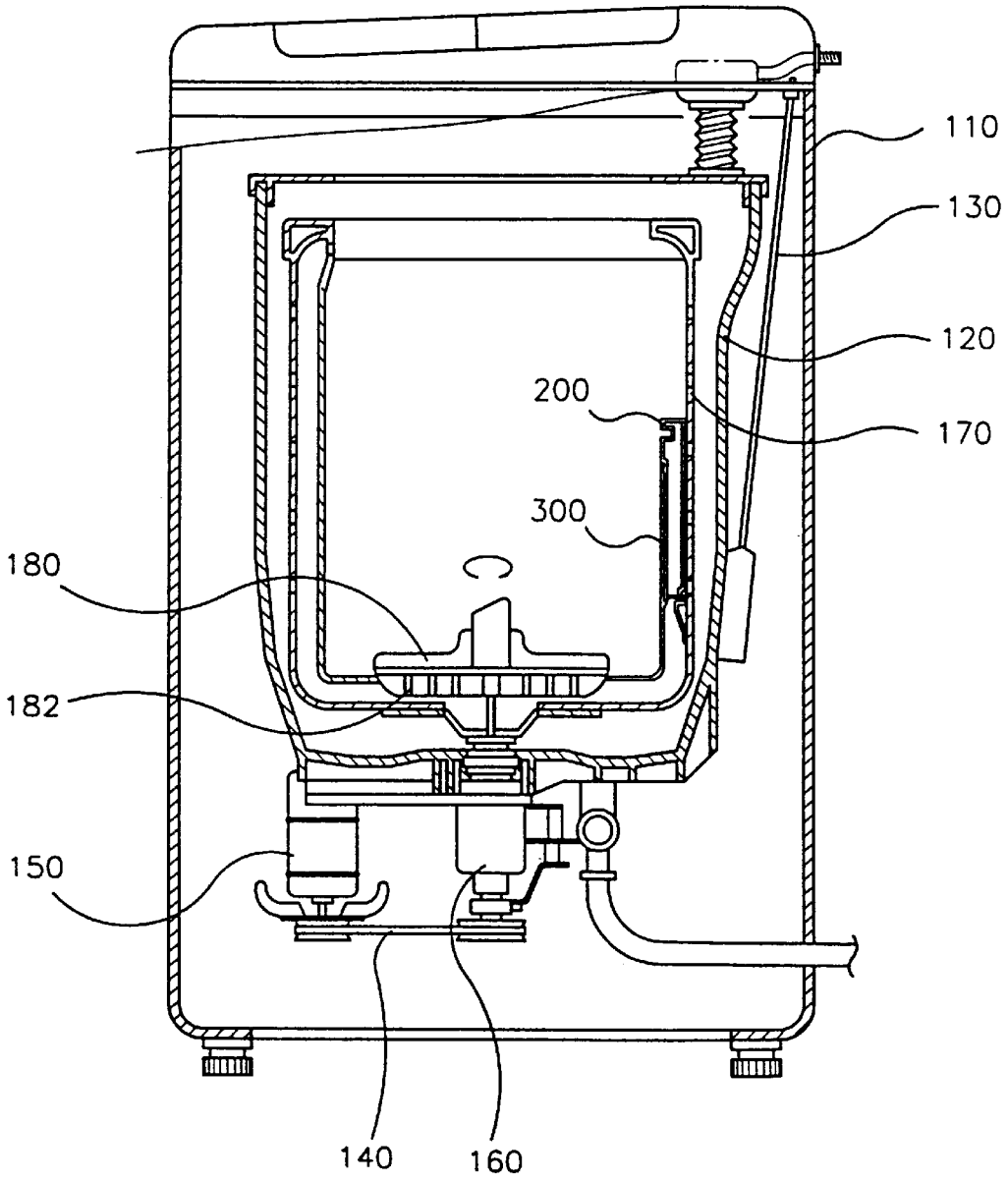
FIG. 2 PRIOR ART
FIG. 2 is a sectional view showing other general full automatic washing machine having a filter.
Figure 3:
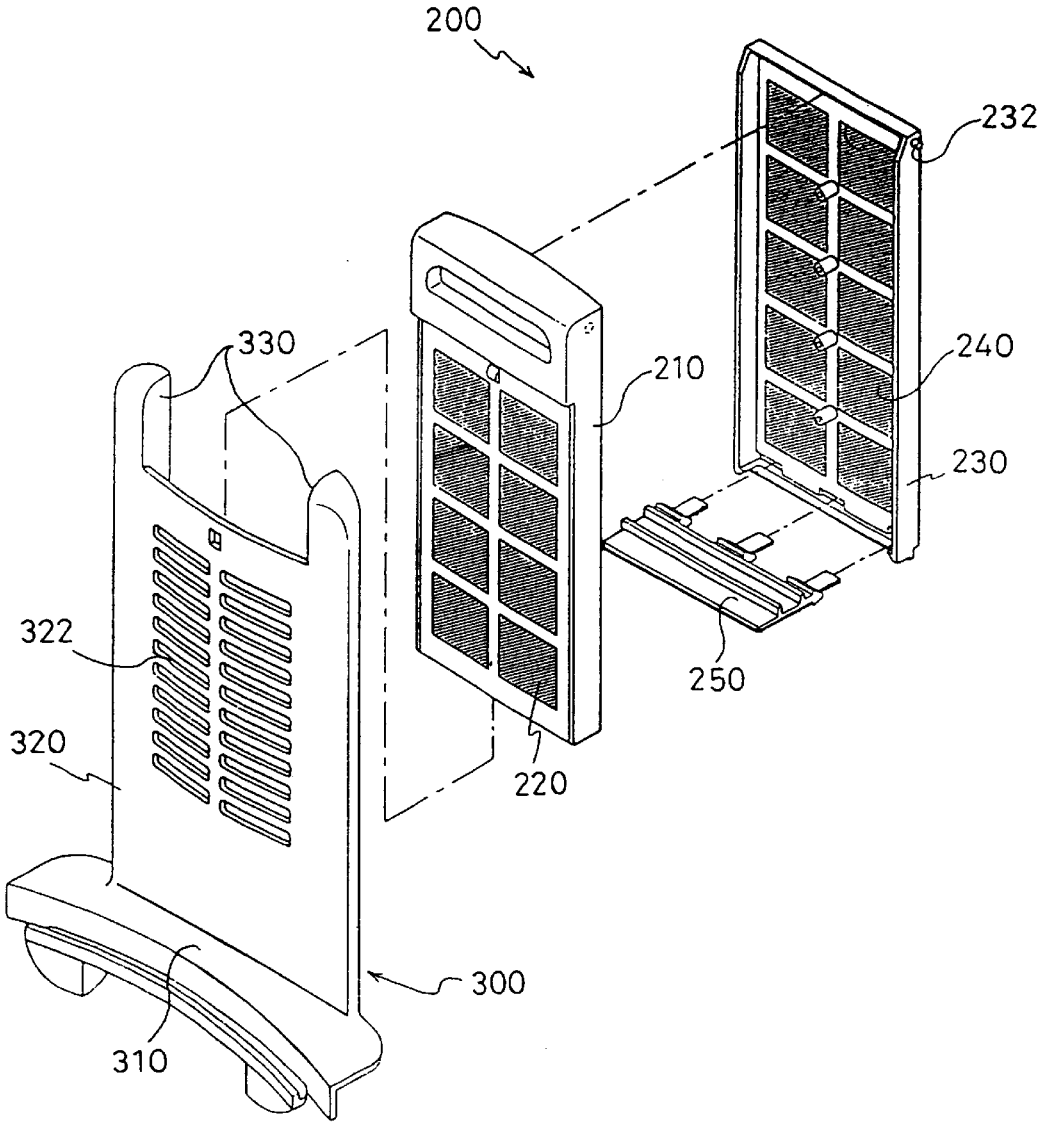
FIG. 3 PRIOR ART
FIG. 3 is an exploded perspective view of the filter shown in FIG. 2.
Figure 4:
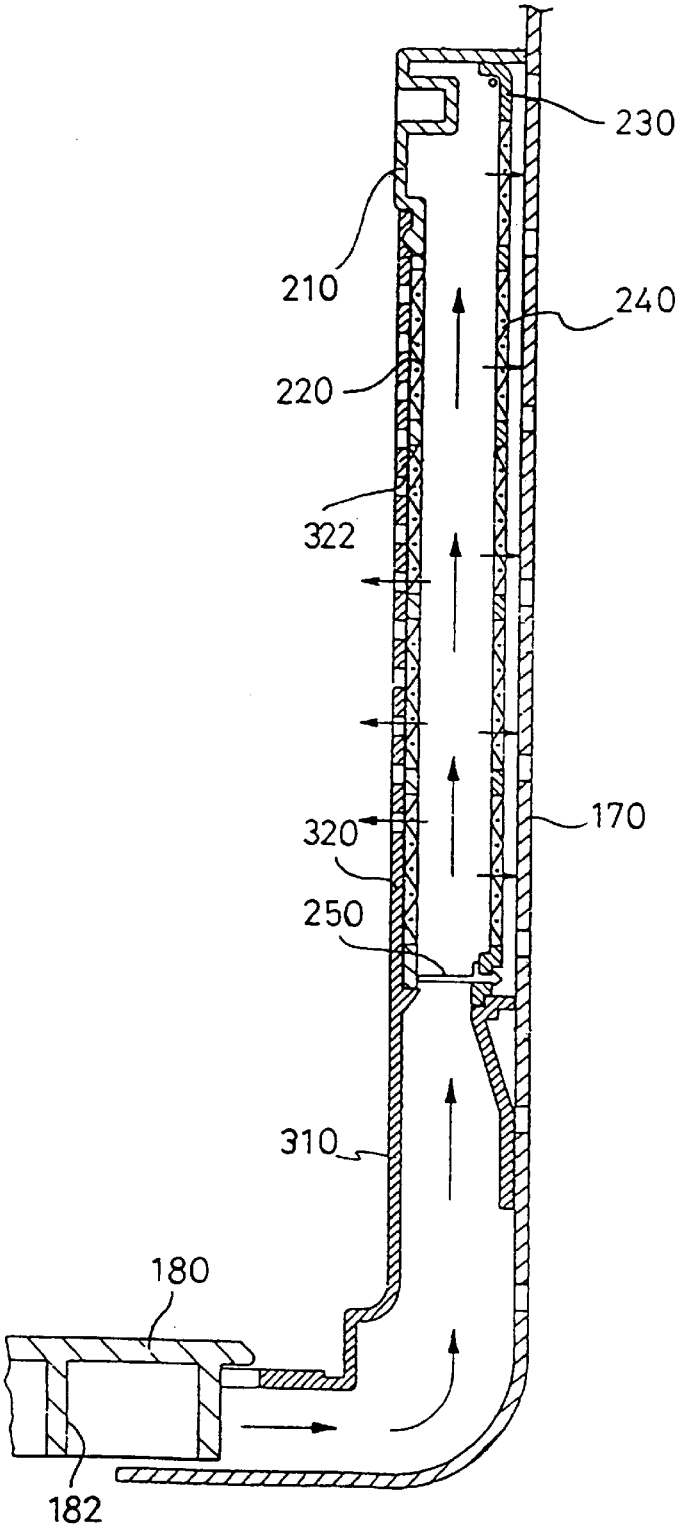
FIG. 4 PRIOR ART
FIG. 4 is a detailed sectional view showing the portion shown in FIG. 2 where the filter for a washing machine is mounted.
Figure 5:
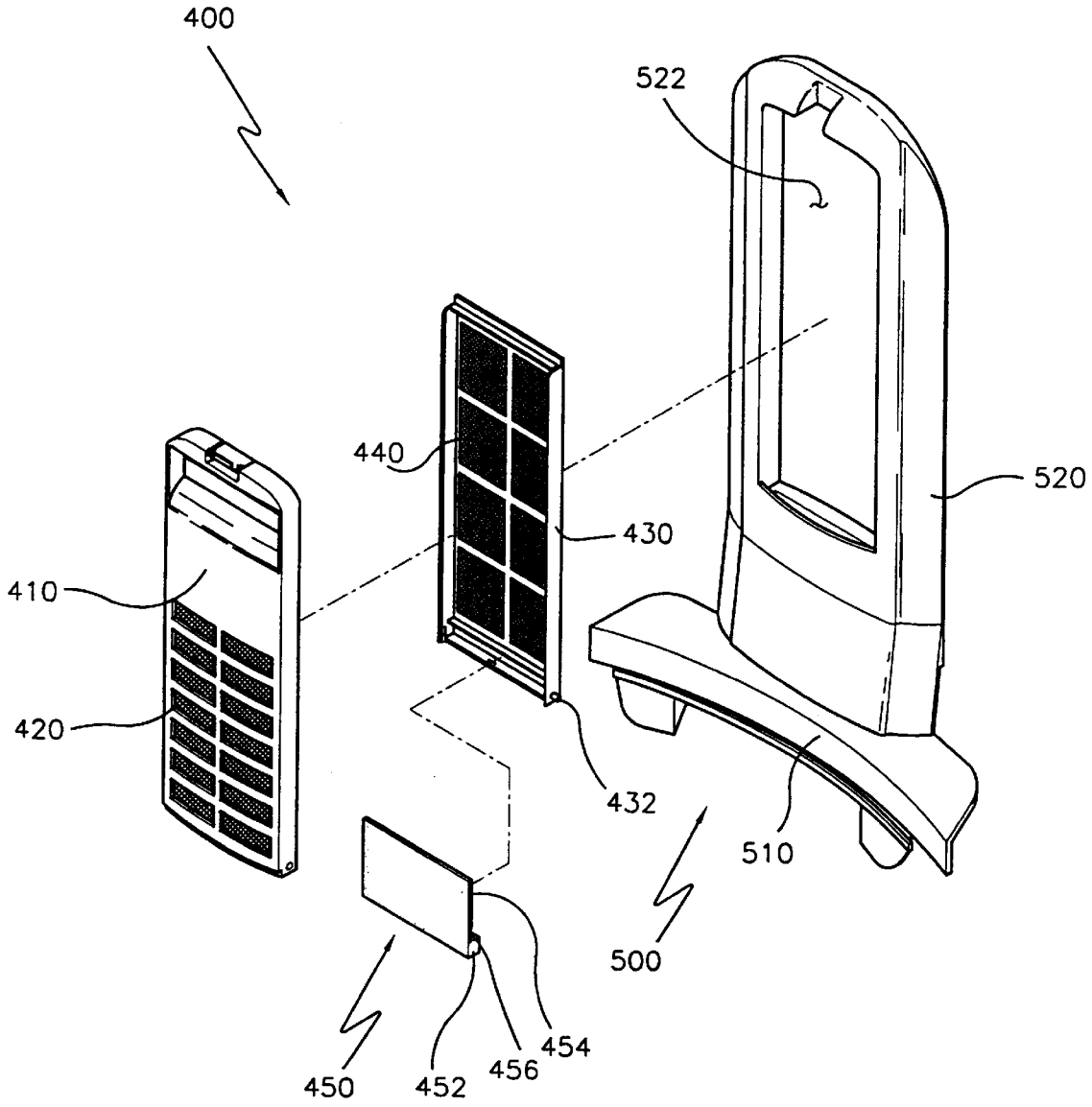
FIG. 5 is an exploded perspective view showing a filter for a washing machine according to the present invention.
Figure 6:
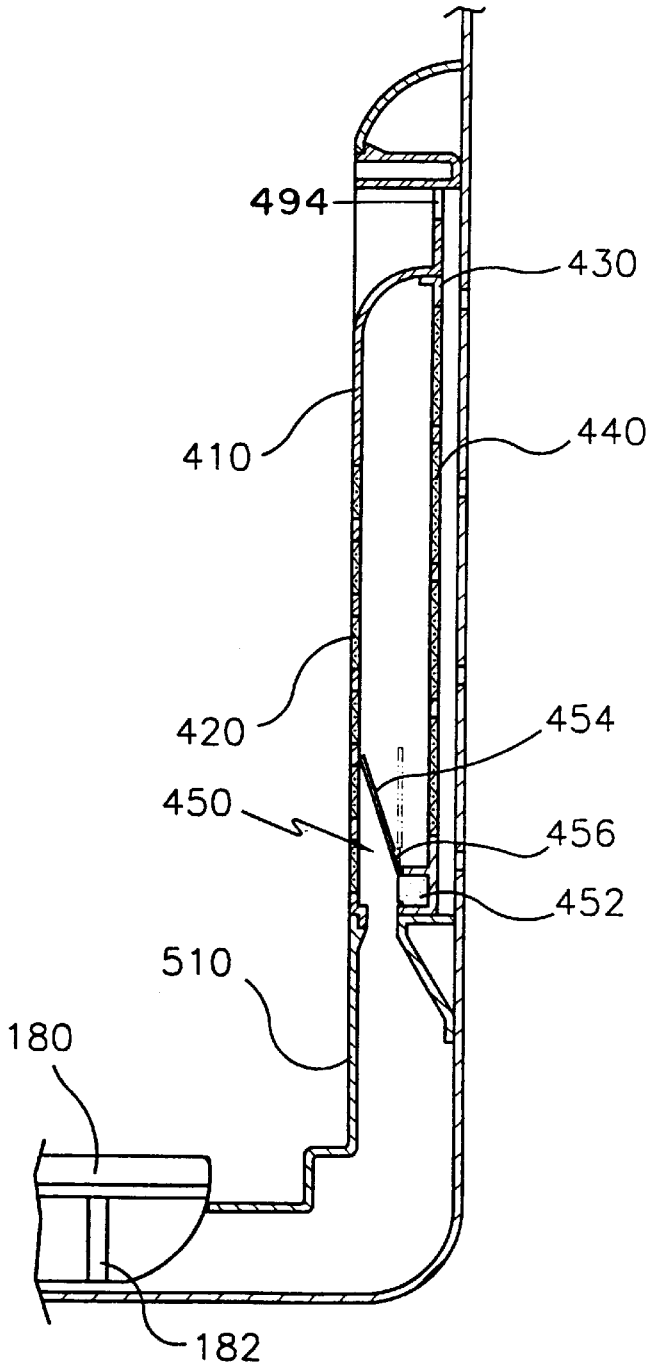
FIG. 6 is a sectional view showing a state that the filter for a washing machine according to the present invention attached to a washing machine.

A filter according to a preferred embodiment of the present invention is shown in FIGS. 5 to 6.

As illustrated, a filter for a washing machine according to the present invention is attached to the inner lower portion of a dehydrating tub 170, which includes a filter case 500 and a pocket type filter 400 for filtering fluff by being inserted into filter case 500.

Filter case 500 includes an attachment portion 510 for attaching itself onto dehydrating tub 170 and a filter receiving portion 520 formed with an opening 522 into which pocket type filter 400 is inserted from preceding side thereof.

Pocket type filter 400 includes a front panel 410, a rear panel 430, and a check valve 450. Front panel 410 and rear panel 430 are coupled to be opened/closed by a hinge shaft 432 formed to rear panel 430, and attached with mesh nets 420 and 440 for filtering the fluff respectively. Front panel 410 is formed with a penetrating hole 494 at upper portion thereof.

Check valve 450 for opening/closing the space between front panel 410 and rear panel 430, is fixed to the lower side of rear panel 430 and made of a material such as a rubber. Check valve 450 such as describe above includes a fixing portion 452 to be fixed to lower side of rear panel 430 by being inserted into a fixing recess formed at the lower side of rear panel 430, a moving plate 454 for opening/closing the space between front panel 410 and rear panel 430, and a connecting portion 456 for connecting fixing portion 452 with moving plate 454. Moving plate 454 is extended from fixing portion 452 to be inclined toward front panel 410 and pivoted by the stream of the washing water. Connecting portion 456 is thinner less than moving plate 454.

Since the operation of the filter for a washing machine according to the present invention is same to the operation of the other example of the prior art, the description of the operation is abbreviated.

According to the present invention as described above, check valve 450 is fixed to the lower side of rear panel 430 and has a length longer than the distance between front panel 410 and rear panel 430. Thus, even if a lot of fluff is accumulated in pocket type filter 400 check valve 450 is capable of supporting the weight of the fluff by which upper portion of moving plate 454 contacts and frictionizes the inner side of front panel 410. Therefore, it is prevented from separating of moving plate 454 from front panel 410 occurred by which moving plate 454 is sunk down, so that the fluff accumulated in pocket type filter 400 does not leak out.

In addition, since thin connecting portion 456 is disposed between moving plate 454 and fixing portion 452 of check valve 450, so that moving plate 454 may easily move even if has a thickness enough to support the weight of the fluff. Accordingly, the opening/closing operation of check valve 450 by the stream of the washing water introduced into pocket type filter 400 is reliably performed even if moving plate 454 has a thickness enough to support the weight of the fluff, so that the efficiency of pocket type filter 400 is enhanced and the washing effect of a washing machine is also increased.

While the present invention has been particularly shown and described with reference to particular embodiment thereof, it will be understood by those skilled in the art that various changes in form and details may be effected therein without departing from the spirit and scope of the invention as defined by the appended claims.

What is claimed is:

1. A filter for a washing machine comprising:

a filter case attached to an inner lower portion of a dehydrating tub of the washing machine for forming a predetermined space with the dehydrating tub, including an attachment portion for being attached to the dehydrating tub and a filter receiving portion formed with an opening portion; and a pocket type filter including a front panel attached with a mesh net to one side thereof and formed with a penetrating hole at upper portion thereof for filtering fluff intermingled in washing water, a rear panel for forming a predetermined space with the front panel by being coupled to the front panel by hinge shafts to be opened/closed while being attached with a mesh net for filtering the fluff intermingled in the washing water to one side thereof, and a check valve fixed to be upwardly inclined toward the front panel to a lower side of the rear panel for confining the flow of the washing water introduced into the space between the front panel and the rear panel, the pocket type filter being inserted into the filter receiving portion.

2. The filter for a washing machine as claimed in claim 1, wherein the check valve comprises a fixing portion which is fixed to the lower side of the rear panel by being inserted into a fixing recess formed at the lower side of the rear panel, and a moving plate which is extended from the fixing portion to be inclined toward the front panel and opens/closes the space between the front panel and the rear panel.

3. The filter for a washing machine as claimed in claim 2, wherein the check valve further comprises a connecting portion for connecting the fixing portion to the moving plate and having a thickness thinner than the moving plate.

* * * * *